US007467975B2

(12) United States Patent
Ma

(10) Patent No.: US 7,467,975 B2
(45) Date of Patent: Dec. 23, 2008

(54) ELECTRICAL CONNECTOR

(75) Inventor: Wen-Qiang Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/011,061

(22) Filed: Jan. 23, 2008

(65) Prior Publication Data

US 2008/0176459 A1 Jul. 24, 2008

(30) Foreign Application Priority Data

Jan. 23, 2007 (CN) ..... 2007 2 0034033 U

(51) Int. Cl.
*H01R 13/648* (2006.01)

(52) U.S. Cl. ..... 439/607

(58) Field of Classification Search ..... 439/608, 439/609, 607, 108, 496
See application file for complete search history.

(56) References Cited

U.S. PATENT DOCUMENTS 7,086,902 B1 * 8/2006 Yang ..... 439/607
7,147,481 B2 * 12/2006 Yang ..... 439/71
7,223,125 B2 * 5/2007 Chen ..... 439/609
7,232,316 B2 * 6/2007 Chen ..... 439/71
7,309,238 B2 * 12/2007 Yang ..... 439/71
D565,510 S * 4/2008 Ma ..... D13/147

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector for receiving an electronic component therein, comprises an insulating housing defining a receiving room; a plurality of contacts mounted in the housing; and a top shell mounted on the top of the housing. The top shell comprises a pair of opposite first wall and a pair of opposite second wall. A bending portion extends from the top of each first wall toward the receiving room. An assembling portion extends from the bottom of each bending portion downwardly, and a corresponding assembling groove is defined on the housing and engages with the assembling portion for fixing the top shell onto the housing.

15 Claims, 3 Drawing Sheets

ELECTRICAL CONNECTOR

BACKGROUND OF THE INVENTION

1. Field of the Invention

The present invention relates to an electrical connector, and more particularly to an electrical connector used for a mobile phone or other electrical devices for mounting of a camera module.

2. Description of the Prior Art

With the rapid development of the technology of wireless communication and advanced technology of electronics, the electronic consumer products such as mobile phone, Personal Digital Assistant (PDA) etc., are designed to comply with miniaturization trend and multiple functions such as mounting a camera thereon to meet a user's need. As a result, the requirement of socket connectors used in such equipments is correspondingly demanding.

An electrical connector for receiving an electrical component comprises an insulating housing having a receiving room, a plurality of contacts insert-molded with the housing, and a top shell and a bottom shell together covering the housing. The top shell consists of a pair of U-shaped metal frames defining a pair of opposite first walls and a second wall connecting the two first walls. Several grounding strips and fastening strips extend from the top of the second wall into the receiving room. A resilient strip extends from the top of the first wall into the receiving room. A pair of tabs protrudes on the two sides of the resilient strip adjacent to the top of the first wall, and the housing has a corresponding assembling groove engaging with the tabs for fastening the top shell onto the housing.

However, one problem of above said connector is that each metal frame of the top shell engaged with the housing only by means of the tabs and two assembling grooves so that a holding force between the top shell and the housing is inadequate and the quality of the products may not be guaranteed as the top shell may come adrift or even separate from the housing.

Hence, an improved electrical connector is desired to overcome the disadvantages of the prior art.

BRIEF SUMMARY OF THE INVENTION

Therefore, a main object of the present invention is to provide an electrical connector which supplies firm holding force between the top shell and the housing of the connector.

To fulfill the above-mentioned object, an electrical connector according to the present invention comprises an insulating housing defining a receiving room; a plurality of contacts mounted in the housing; and a top shell mounted on the top of the housing. The top shell comprises a pair of opposite first wall and a pair of opposite second wall. A bending portion extends from the top of each first wall toward the receiving room. An assembling portion extends from the bottom of each bending portion downwardly, and a corresponding assembling groove is defined on the housing and engages with the assembling portion for fixing the top shell onto the housing.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
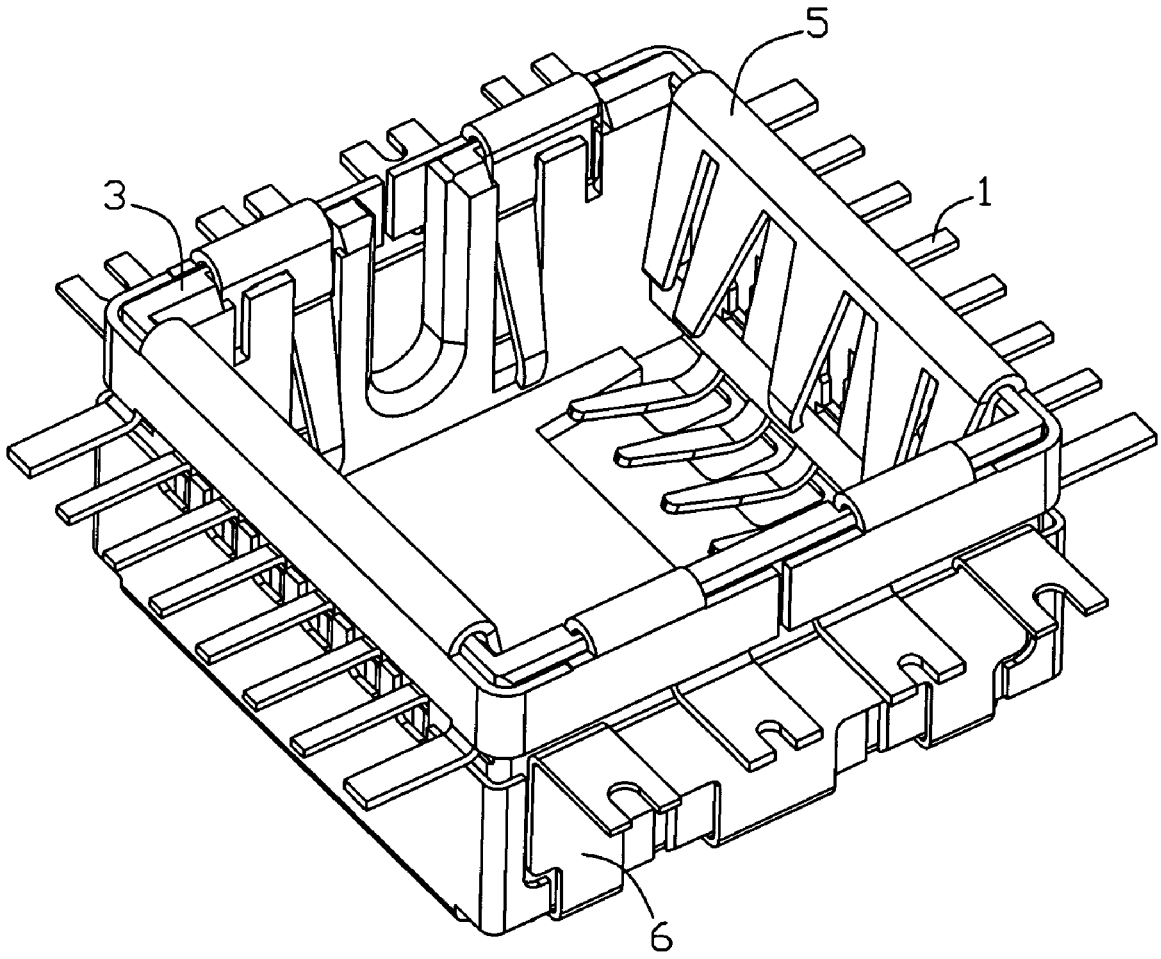
FIG. 1 is a perspective view of an electrical connector of the present invention.
Figure 2:
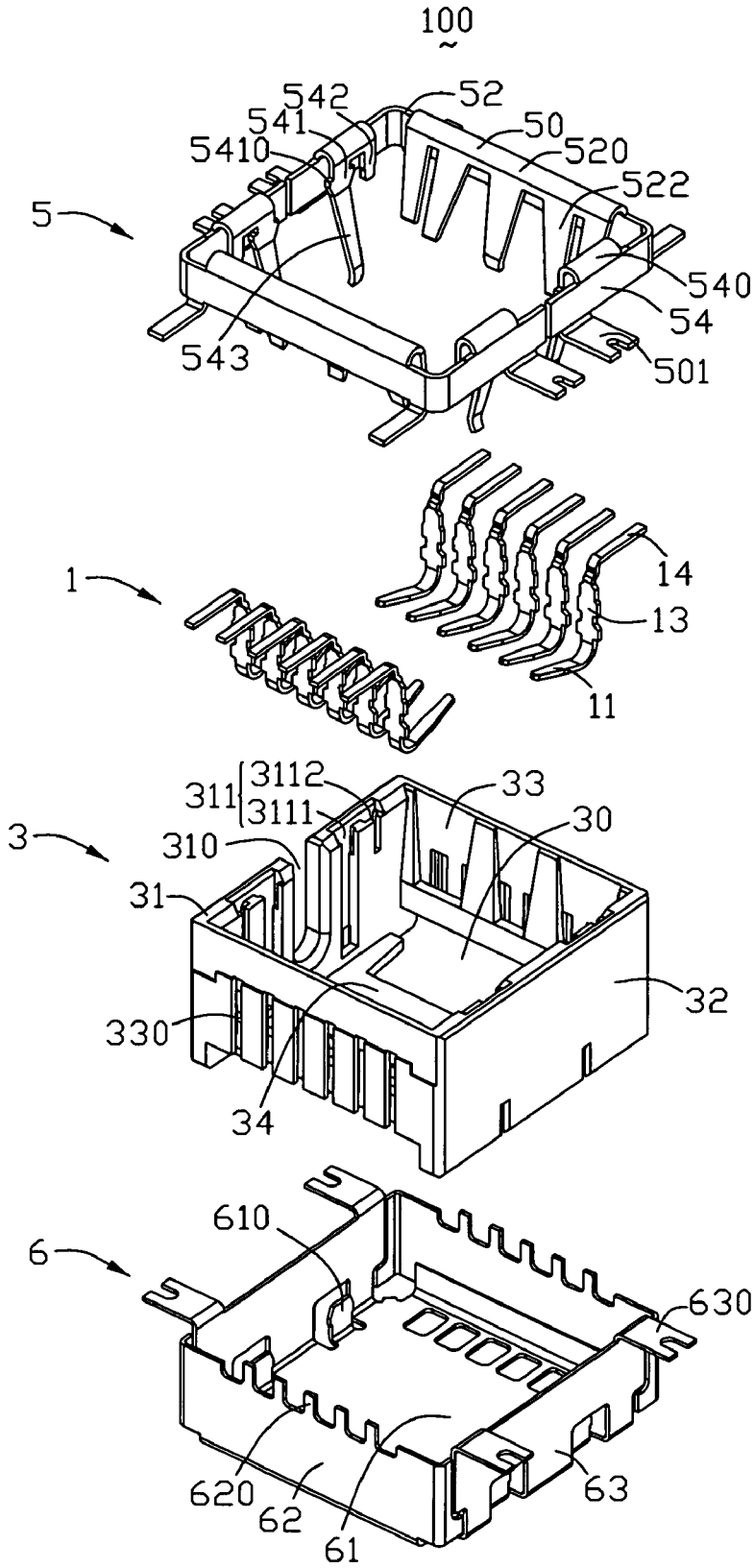
FIG. 2 is an exploded view of FIG. 1.
Figure 3:
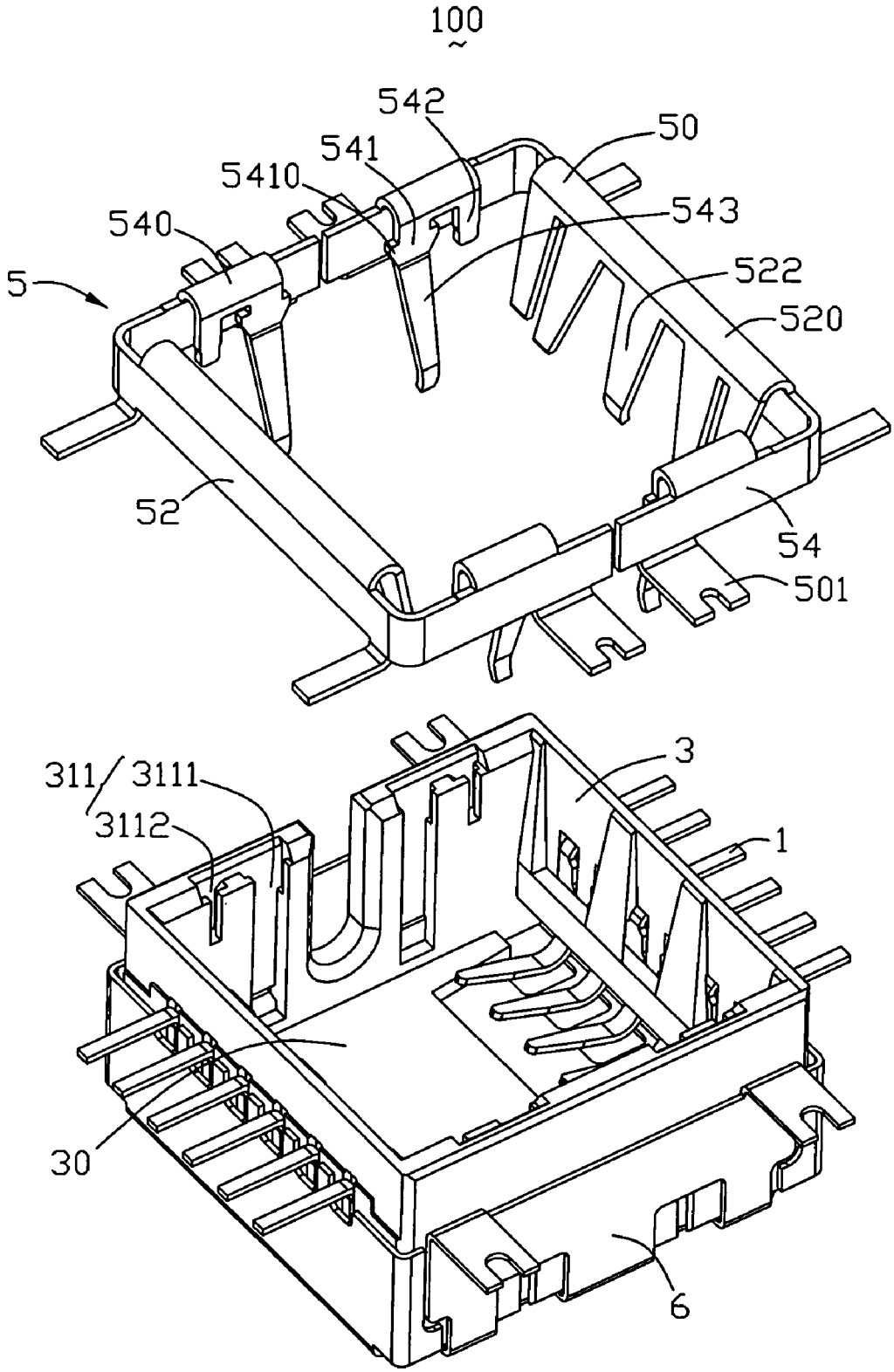
FIG. 3 is a view similar to FIG. 1, but the top shell is separated from the housing.

Referring to FIGS. 1-3, an electrical connector 100 according to the present invention is adapted for receiving an electrical component and in this embodiment said electrical component is a camera module (not shown). The electrical connector 100 comprises an insulating housing 3 defining a receiving room 30, a plurality of contacts 1 mounted in the housing 3, a top shell 5 and a bottom shell 6 together covering the housing 3.

The top shell 5 mounted on the top of the housing 3 consists of a pair of U-shaped metal frames 50. Each frame 50 comprises a pair of approximately symmetrical first wall 54 and a second wall 52 connecting the two first walls 54. A first bending portion 520 extends from the top of the second wall 52 and bends toward the receiving room 30. Several first resilient arms 522 extend from the free end of the first bending portion 520 to the receiving room 30 for engaging with the camera module firmly. A second bending portion 540 extends from the top of the first wall 54 and bends toward the receiving room 30. A first assembling portion 541 and a second assembling portion 542 extends from the free end of the second bending portion 540 downwardly. A pair of tabs 5410 protrudes from the two sides of the first assembling portion 541 for engaging with the housing. The first assembling portion 541 and the second assembling portion 542 together constitute a double-row assembling portion. A second resilient arm 543 extends from the bottom of the first assembling portion 541 to the receiving room 30 for engaging with the camera module. Several first soldering portions 501 perpendicularly bend from the bottom of the second wall 52 and the bottom of the first wall 54.

The bottom shell 6 for covering the bottom of the housing 3 comprises a planar base 61, a pair of third walls 63 and a pair of fourth walls 64 extending from the four sides of the base 61 upwardly. Two pairs of engaging patches 610 are formed at the base 61 adjacent to the two opposite fourth walls 63 engaging with the housing 3 for fixing the bottom shell 6 onto the housing 3. A pair of second soldering portions 630 extends from the top of each fourth wall 64 outwardly. Several tabs 620 extend from the top of the third wall 62 upwardly, and every two adjacent tabs 620 have same distance.

The housing 3 comprises a front wall 31, a rear wall 32, a pair of sidewalls 33 connecting the front wall 31 and the rear wall 32, and a footwall 34 together forming the receiving room 30 for receiving the camera module. A cutout 310 is defined at a central portion of the front wall 31 for accommodating a projecting portion (not shown) of the camera module. Several notches (not shown) are defined on the bottom of the front wall 31 and the rear wall 32 engaging with the engaging tabs 610 for fastening the bottom shell 6 and the housing 3 firmly. Two pairs of double-row assembling grooves 311 are respectively defined on the front wall 31 and the rear wall 32 engaging with the corresponding double-row assembling portions for fastening the top shell 5 and the housing 3 firmly. Each double-row assembling groove comprises a first assembling groove 3111 engaging with the corresponding tabs 5410 of the first assembling portion 541 and a second assembling groove 3112 engaging with the corresponding second assembling portion 542. A plurality of slits 330 is defined on each sidewall 33. The footwall 34 is H-shaped and connects the front wall 31 and the rear wall 32.

The contact 1 is mounted on the corresponding slit 330 of the housing 3 and comprises a fastening portion 13 engaging with the slit 330, a conducting portion 11 bending and extending from the bottom of the fastening portion 13 receiving in the receiving room 30, and a third soldering portion 14 extending from the top of the fastening portion 13 outwardly and lying between the two adjacent tabs 620.

In use, firstly, the first soldering portions 501, the second soldering portions 630, the third soldering portions 14 of the connector are respectively soldered onto the corresponding conducting pad (not shown) of the printed circuit board (not shown); then the camera module is put into the receiving room, so the resilient arms 522, 543 engage with the camera module and the conducting portions 11 of the contacts 1 respectively contact the corresponding conducting areas (not shown) of the camera module. A circuit path is completed.

In the present invention, via the double-row assembling portion engaging with the double-row assembling groove 311, the top shell 5 is fixed to the housing 3. Compared to the related arts where the top shell is fixed to the housing only via single assembling portion engaging with the assembling groove, the combination of the housing and the top shell of the present invention is firmer, thus could prevent the top shell from separating the housing in transport or assembling.

In other alternative embodiments, the second assembling portion 542 may protrude a pair of tabs 5410 from the two sides engaging with the second assembling groove 3112; or the first assembling portion 541 may not have any tab, so the first assembling portion 541 and the second assembling portion 542 respectively engage with the corresponding assembling grooves 3111, 3112; or both assembling portions 541, 542 may respectively extend the second resilient arms 543 engaging with the camera module; or the assembling groove 311 is a multi-row assembling groove, and the top shell 5 has a corresponding assembling portion engaging with the assembling groove 311.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for receiving an electronic component such as camera module, comprising:

an insulating housing defining a receiving room;

a plurality of contacts mounted in the housing; and a top shell mounted on the top of the housing and consists of a pair of U-shaped metal frames, each frame comprising a first wall connecting to a pair of opposite second walls;

wherein a first bending portion extends from the top of the first wall and bends toward the receiving room; several first resilient arms extend from a free end of the first bending portion to the receiving room for engaging with the electronic component firmly; and a second bending portion extends from the top of the second wall and bends toward the receiving room, the second bending portion comprising a first assembling portion and a second assembling portion extends from the free end of the second bending portion downwardly, a pair of tabs protrudes from the two sides of the first and second assembling portions for engaging with first and second assembling grooves of the housing for fixing the top shell onto the housing; a second resilient arm extends from the first assembling portion to the receiving room for engaging with the electronic component; several first soldering portions perpendicularly bend from the bottom of the second walls and the bottom of the first wall;

a bottom shell attached to a bottom of the housing and jointly with the top shell to surround the housing.

2. The electrical connector as described in claim 1, wherein footwall forming in the receiving room for receiving the electronic component.

3. The electrical connector as described in claim 1, wherein the first and second assembling portions of the top shell are a double-row assembling portion, and the corresponding first and second assembling grooves of the housing are a double-row assembling groove.

4. The electrical connector as claimed in claim 3, wherein the two pairs of engaging patches forming at a base of the bottom shell to engage with the housing.

5. The electrical connector as claimed in claim 4, wherein several tabs extending from a top edge wall of the bottom shell and spacing each other by a same distance.

6. An electrical connector for receiving an electronic component such as camera module, comprising:

an insulating housing defining a receiving space;

a plurality of passageways defined in an other pair of opposite sidewalls and extending from a bottom of the housing into an other pair of opposite sidewalls;

a plurality of contact terminals assembled to the plurality of passageways, and each including a base portion retained within the passageway, and a tail portion extending outside of the other pair of opposite sidewalls and located adjacent to a top edge of the other pair of sidewalls, and a contact engaging portion extending into the receiving space from the bottom of the housing;

a first shielding element mounted on a top of the housing and consists of a pair of U-shaped metal frames, each frame comprising a first wall connecting to a pair of opposite second walls;

wherein a first bending portion extends from a top of the first wall and bends toward the receiving space; several first resilient arms extend from a free end of the first bending portion to the receiving space for engaging with the electronic component firmly; and a second bending portion extends from a top of the second wall and bends toward the receiving room, the second bending portion comprising a first assembling portion and a second assembling portion extends from the free end of the second bending portion downwardly, a pair of tabs protrudes from the two sides of the first and second assembling portions for engaging with first and second assembling grooves of the housing for fixing the first shielding element onto the housing: a second resilient arm extends from the first assembling portion to the receiving space for engaging with the electronic component; several first soldering portions perpendicularly bend from the bottom of the second walls and the bottom of the first wall;

a second shielding element attached to a bottom of the housing and jointly with the first shield element to substantially surround the housing and the contact terminals.

7. The electrical connector as recited in claim 6, wherein several tabs extending from a top edge wall of the second shielding element and spacing each other by a same distance.

8. The electrical connector as recited in claim 6, wherein two pairs of engaging patches forming at a base of the second shielding element to engage with the housing.

9. The electrical connector as recited in claim 8, wherein the first shielding element includes grounding fingers extending into the housing and located adjacent to the sidewalls.

10. The electrical connector as recited in claim 6, wherein the second shielding element includes first mounting tabs located adjacent to the first pair of the sidewalls.

11. The electrical connector as recited in claim 10, wherein the first shielding element includes mounting tabs offset from the first mounting tabs of the second shielding element.

12. The electrical connector as recited in claim 11, wherein the second shielding element includes third mounting tabs located to the mounting portion of the contact terminals.

13. A product of method for configuring a shielded electrical connector, comprising the steps of:

a) providing an insulative housing having a hollow configuration with a bridging portion interconnecting first opposite sidewalls;

b) providing a plurality of passageways in a second opposite sidewall and extending from a bottom of the housing thereof;

c) providing a plurality of contact terminals assembled into the plurality of passageways and extending a tail portion of each terminal outside of the other pair of opposite sidewalls to be adjacent to a top edge of other pair of sidewalls; and extending a contact engaging portion into the hollow from the bottom of the housing;

d) providing a first shielding element attached to the top of the housing from the bottom; and consists of a pair of U-shaped metal frames, each frame comprising a first wall connecting to a pair of opposite second walls;

e) extending a first bending portion from the top of the first wall and bends toward the receiving room;

f) extending several first resilient arms from a free end of the first bending portion to the receiving room for engaging with the electronic component firmly; and g) extending a second bending portion from the top of the second wall and bends toward the receiving room;

h) the second bending portion comprising a first assembling portion and a second assembling portion and extends from the free end of the second bending portion downwardly;

i) protruding a pair of tabs from the two sides of the first and second assembling portions for engaging with first and second assembling grooves of the housing for fixing the top shell onto the housing;

k) extending a second resilient arm from the first assembling portion to the receiving room for engaging with the electronic component;

l) bending several first soldering portions perpendicularly from the bottom of the second walls and the bottom of the first wall;

m) attaching a second shielding element to the housing from the top thereof so as to substantially enclosing the housing along with the first shielding element.

14. The method as recited in claim 13, wherein the first shielding element includes grounding fingers extending toward a center of the housing.

15. The method as recited in claim 14, the second shielding element includes mounding portions extending away from the first pair of sidewalls.

* * * * *